US009098045B2

(12) United States Patent
Ozaki et al.

(10) Patent No.: US 9,098,045 B2
(45) Date of Patent: Aug. 4, 2015

(54) IMAGE FORMING APPARATUS

(71) Applicant: Brother Kogyo Kabushiki Kaisha, Nagoya-shi, Aichi-ken (JP)

(72) Inventors: Yusuke Ozaki, Nagoya (JP); Hideaki Deguchi, Nagoya (JP); Keita Hironaka, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/228,284

(22) Filed: Mar. 28, 2014

(65) Prior Publication Data

US 2014/0376975 A1 Dec. 25, 2014

(30) Foreign Application Priority Data

Jun. 21, 2013 (JP) ..... 2013-130894

(51) Int. Cl.
*G03G 15/16* (2006.01)
*G03G 15/00* (2006.01)

(52) U.S. Cl.
CPC ..... *G03G 15/657* (2013.01); *G03G 15/6529* (2013.01); *G03G 15/6573* (2013.01); *G03G 2215/00413* (2013.01); *G03G 2215/00649* (2013.01); *G03G 2215/00679* (2013.01); *G03G 2215/00683* (2013.01)

(58) Field of Classification Search
CPC ..... G03G 15/657; G03G 2215/00413; G03G 2215/00649; G03G 2215/00679
USPC ..... 399/316, 400
See application file for complete search history.

(56) References Cited

U.S. PATENT DOCUMENTS

| | | | | |
|---|---|---|---|---|
| 7,680,449 | B2 | 3/2010 | Shimizu | |
| 2006/0182479 | A1* | 8/2006 | Miyake | 399/400 |
| 2006/0198668 | A1* | 9/2006 | Tsujita | 399/315 |
| 2007/0147920 | A1* | 6/2007 | Shimizu | 399/400 |

FOREIGN PATENT DOCUMENTS

| | | | |
|---|---|---|---|
| JP | S59-151175 | A | 8/1984 |
| JP | H04-146456 | A | 5/1992 |
| JP | H08-110665 | A | 4/1996 |
| JP | 2007-176611 | A | 7/2007 |

* cited by examiner

*Primary Examiner* — Benjamin Schmitt
(74) *Attorney, Agent, or Firm* — Banner & Witcoff, Ltd.

(57) ABSTRACT

An image forming apparatus includes: a photosensitive drum; a transfer roller configured to form a nip portion; and a sheet guide that is configured to guide a recording sheet. The sheet guide comprises: a conductor configured to face the recording sheet, and insulating ribs that are arranged corresponding to a printing area of the recording sheet in a width direction and are configured to protrude from the conductor to guide the recording sheet. The conductor comprises: a central portion, and a pair of end portions and are configured to protrude towards the recording sheet from a virtual plane extending from the central portion in the width direction. Protrusion amounts of the end portions with respect to the central portion are smaller than a protrusion amount of each rib from the central portion of the conductor.

14 Claims, 4 Drawing Sheets

IMAGE FORMING APPARATUS

CROSS REFERENCE TO RELATED APPLICATION

This application is based upon and claims the benefit of priority of Japanese Patent Application No. 2013-130894 filed on Jun. 21, 2013, the contents of which are incorporated herein by reference in its entirety.

BACKGROUND

The present disclosure relates to an image forming apparatus having a sheet guide.

An image forming apparatus has been known which has a sheet guide having an electrically grounded metal plate and a plurality of ribs protruding from the metal plate towards a sheet between a transfer unit and a fixing unit. According to this technology, a sheet that passes through the transfer unit and is thus charged is attracted towards the sheet guide by the metal plate, so that conveyance of the sheet is stabilized, and the sheet is not contacted to the metal plate by the ribs, so that an electric discharge, which is caused when the sheet is contacted to the metal plate, is suppressed.

SUMMARY

In an environmental situation where the charging of the sheet having passed through the transfer unit is weakened, the sheet may not be appropriately attracted towards the sheet guide. Therefore, it is necessary to increase an attraction force of the metal plate by bringing the metal plate close to the sheet. However, when the sheet and the metal plate come too close to each other in a printing area, an electric discharge may occur by the attraction force of the meal plate.

Therefore, an object of an aspect of the present disclosure is to provide an image forming apparatus having a sheet guide capable of easily attracting a sheet while suppressing an electric discharge.

The aspect of the present disclosure provides the following arrangements.

An image forming apparatus comprising:

a photosensitive drum;

a transfer roller configured to form a nip portion together with the photosensitive drum to transfer an image formed on the photosensitive drum onto a recording sheet; and a sheet guide that is configured to guide the recording sheet having passed through the nip portion along a guide path in a conveyance direction, wherein the sheet guide comprises:

a conductor configured to face the recording sheet, and a plurality of insulating ribs that are arranged, corresponding to a printing area of the recording sheet, in a width direction of the recording sheet substantially perpendicular to the conveyance direction and that are protruding from the conductor to guide the recording sheet, wherein the conductor comprises:

a central portion arranged at an area corresponding to the printing area in the width direction, and a pair of end portions, each of which is arranged at a corresponding side of the central portion in the width direction and outside the printing area and each of which is protruding towards the guide path relative to the central portion, and wherein protrusion amounts of the end portions with respect to the central portion are smaller than a protrusion amount of each rib from the central portion of the conductor.

An image forming apparatus comprising:

a photosensitive drum;

a transfer roller configured to form a nip portion together with the photosensitive drum to transfer an image formed on the photosensitive drum onto a recording sheet; and a sheet guide that is configured to guide the recording sheet having passed through the nip portion along a guide path in a conveyance direction, wherein the sheet guide comprises:

a conductor configured to face the recording sheet, and a plurality of insulating ribs that are arranged, corresponding to a printing area of the recording sheet, in a width direction of the recording sheet substantially perpendicular to the conveyance direction and that are protruding from the conductor to guide the recording sheet, wherein the conductor comprises:

a first portion, and a second portion protruding towards the guide path relative to the first portion, and wherein a protrusion amount of the second portion with respect to the first portion is smaller than a protrusion amount of each rib from the first portion of the conductor.

DESCRIPTION OF EXEMPLARY EMBODIMENTS

Hereinafter, an illustrative embodiment of the present disclosure will be specifically described with reference to the drawings.

Meanwhile, in the below descriptions, a direction is described based on a user who uses a laser printer 1 that is an example of the image forming apparatus. That is, the left side in FIG. 1 is referred to as the 'front', the right side is referred to as the 'rear', the front side is referred to as the 'right' and the inner side is referred to as the 'left.' The upper and lower directions in FIG. 1 are referred to as the 'upper-lower.'

<Schematic Configuration of Laser Printer>

Figure 1:
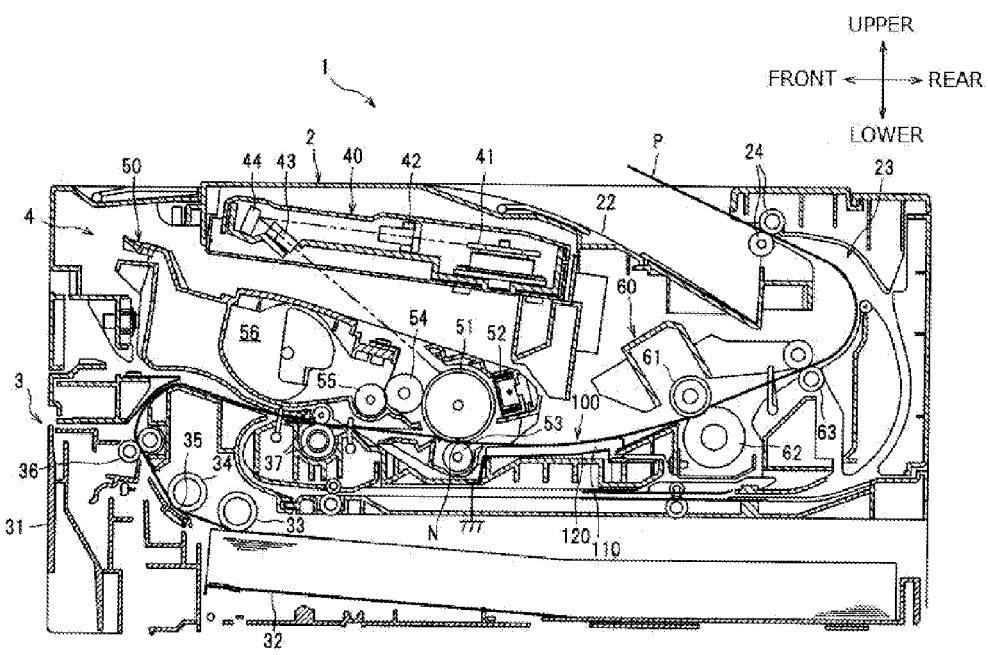
FIG. 1 is a sectional view showing a laser printer according to an exemplary embodiment.

As shown in FIG. 1, the laser printer 1 mainly has, in a main body housing 2, a sheet feeding device 3 that feeds a sheet P, which is an example of the recording sheet, and an image forming unit 4 that forms an image on the fed sheet 3.

The sheet feeding device 3 mainly has a sheet feeding tray 31 that is provided at a lower part in the main body housing 2 and accommodates therein the sheet P, a sheet pressing plate 32, a feeder roller 33, a separation roller 34, a separation pad 35 and conveyance rollers 36. The sheet P in the sheet feeding tray 31 is brought close to the feeder roller 33 by the sheet pressing plate 32 and is delivered towards the separation roller 34 by the feeder roller 33. The delivered sheet P is separated one by one by the separation roller 34 and the separation pad 35 and is fed to the image forming unit 4 by the conveyance rollers 36 and register rollers 37.

The image forming unit 4 mainly has an exposure device 40, a process cartridge 50, a fixing device 60 and a sheet guide 100. The sheet guide 100 will be described later.

The exposure device 40 is provided at an upper part in the main body housing 2 and mainly has a laser light emitting unit (not shown), a polygon mirror 41 that is to rotate, lenses 42, 43 and a reflector 44. A laser light (refer to a dotted and dashed line) that is emitted from the laser light emitting unit and is based on image data is reflected or passes through the polygon mirror 41, the lens 42, the reflector 44 and the lens 43 in corresponding order and is scanned on a surface of a photosensitive drum 51 at high speed.

The process cartridge 50 is arranged below the exposure device 40 and is attached and detached to and from the main body housing 2 through an opening, which is formed when a front cover (a reference numeral thereof is omitted) provided for the main body housing 2 is opened, so as to replace the same. The process cartridge 50 mainly has the photosensitive drum 51, a charger 52, a transfer roller 53, a developing roller 54, a supply roller 55 and a toner accommodation unit 56 that accommodates therein toner.

The fixing device 60 is provided at the rear of the process cartridge 50, and has a heating roller 61 and a pressing roller 62 that is arranged to face the heating roller 61 and presses the heating roller 61. A port of the fixing device 60 for carrying the sheet P therein is positioned at an oblique rear-upper part of a nip portion N formed by the photosensitive drum 51 and the transfer roller 53.

In the image forming unit 4, a surface of the photosensitive drum 51 is uniformly charged by the charger 52 and is then exposed by the high-speed scanning of the laser light from the exposure device 40, so that an electrostatic latent image is formed on the photosensitive drum 51. The toner in the toner accommodation unit 56 is supplied to the developing roller 54 through the supply roller 55 and is carried on the developing roller 54.

Then, the toner carried on the developing roller 54 is supplied to the electrostatic latent image on the photosensitive drum 51, so that the electrostatic latent image becomes visible and a toner image is thus formed on the photosensitive drum 51. After that, the sheet P fed from the sheet feeding device 3 is conveyed between the photosensitive drum 51 and the transfer roller 53, so that the toner image on the photosensitive drum 51 is transferred onto the sheet P.

The sheet P having the toner image transferred thereon is conveyed between the heating roller 61 and the pressing roller 62, so that the toner image is heat-fixed. The sheet P having the toner image heat-fixed thereon is conveyed through a conveyance path 23 by conveyance rollers 63 and is discharged onto a sheet discharge tray 22 from the conveyance path 23 by discharge rollers 64.

<Detailed Configuration of Sheet Guide>

Subsequently, the sheet guide 100 is specifically described.

Figure 2:
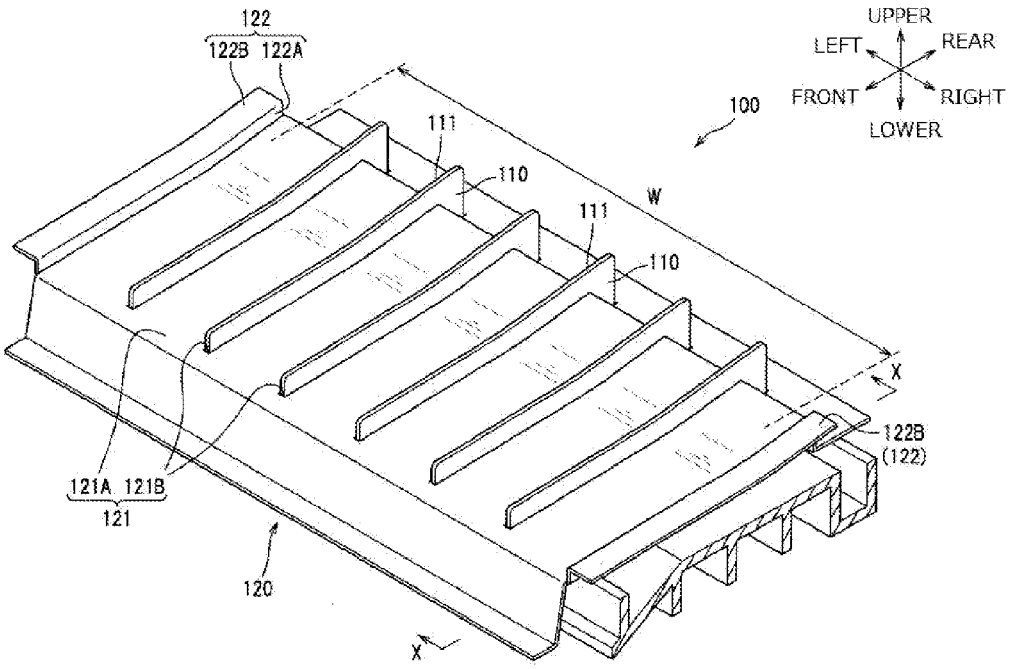
FIG. 2 is a perspective view of a sheet guide, which is obliquely seen from the upper.
Figure 3A:
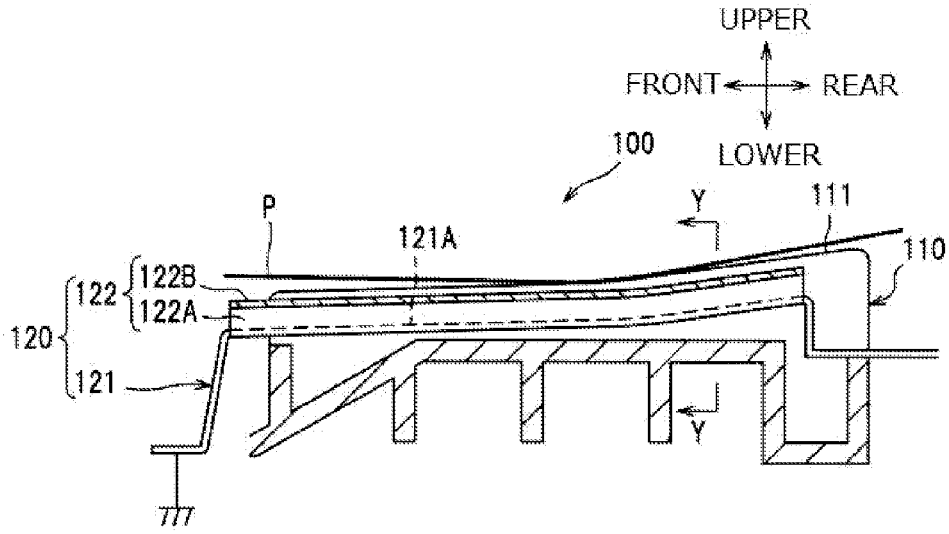
FIG. 3A is a sectional view taken along a line X-X of FIG. 2.
Figure 3B:
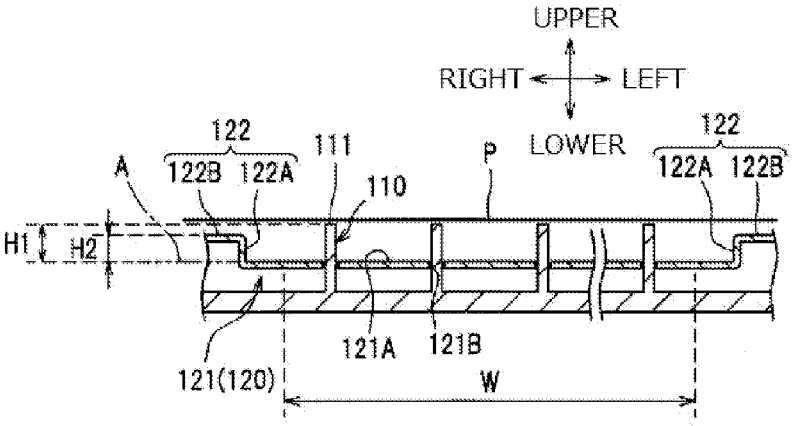
FIG. 3B is a sectional view taken along a line Y-Y of FIG. 3A.

The sheet guide 100 is a member that is configured to guide, along a guide path, a non-printing surface of the sheet P having passed through the nip portion N formed by the photosensitive drum 51 and the transfer roller 53, i.e., a surface of the sheet P facing the transfer roller 53, and has a conductor 120 and ribs 110 protruding upwards from the conductor 120, as shown in FIGS. 2, 3A and 3B.

The conductor 120 is configured by bending a flat plate-shaped metal plate and is arranged at a position facing the sheet P from the lower. The conductor 120 is electrically grounded and an electric potential thereof is zero upon the using. That is, the conductor 120 has an electric potential that attracts the sheet P, which has passed through the nip portion N and is thus charged, towards the conductor 120.

As shown in FIGS. 2 and 3B, the conductor 120 has a central portion 121 in a left-right direction and a pair of end portions 122 provided at both sides of the central portion 121 in the left-right direction. Meanwhile, in this exemplary embodiment, although the central portion 121 and the ribs 122 are integrated, they may be separately configured.

The central portion 121 has a left-right width wider than a printing area W and is positioned within a range corresponding to the printing area W in the left-right direction. As shown in FIG. 3A, the central portion 121 is formed so that it is convex upwards in the front-rear direction, and the convex part becomes a facing surface 121A facing the sheet P.

The facing surface 121A is configured so that an upstream part thereof in a conveyance direction of the sheet P substantially horizontally extends from the front towards the rear and a downstream part thereof is gradually upwardly inclined from the front towards the rear. In the meantime, the configuration of the central portion 121 is not limited thereto and may be arbitrarily set, such as a configuration where the central portion is not inclined.

As shown in FIGS. 2 and 3B, the central portion 121 is formed with a plurality of slits 121B that extends in the front-rear direction within an area corresponding to the printing area W of the left-right direction.

The slits 121B are provided side by side in the left-right direction at positions at which the ribs 110 are arranged, and have a size within which the rib 110 can pass therethrough in the upper-lower direction.

The pair of end portions 122 is located at an area corresponding to the outer sides of the printing area W in the left-right direction and is formed by bending left and right ends of the facing surface 121A so that the end portions more protrude upwardly toward the guide path than the central portion 121. The pair of end portions 122 has protrusion parts 122A that extend upwardly from the left and right ends of the facing surface 121A and extension parts 122B that extend outwardly from upper ends of the protrusion parts 122A in the left-right direction. In the below descriptions, since the pair of end portions 122 have a bilaterally symmetric configuration, only the one is described and the description of the other is omitted.

The extension part 122B is a part that faces the sheet P, and a facing surface thereof protrudes towards the sheet P from a virtual plane A extending outwardly from the facing surface 121A of the central portion 121 in the left-right direction. The extension part 122B is configured so that an upstream part of the facing surface thereof in the conveyance direction of the sheet P substantially horizontally extends from the front towards the rear and a downstream part thereof is gradually upwardly inclined from the front towards the rear. In other words, the extension part 122B is configured so that the downstream side thereof in the conveyance direction of the sheet P is located at a position closer to the photosensitive drum 51 than the upstream side thereof in the facing direction of the transfer roller 53 and the photosensitive drum 51, i.e., in the upper-lower direction.

As shown in FIG. 2, the rib 110 is made of an insulating resin and the like and is elongated in the front-rear direction. The ribs 110 are provided side by side in the left-right direction, i.e., a width direction of the sheet P. As shown in FIG. 3B, the ribs 110 are arranged in the area corresponding to the printing area W in the left-right direction. Meanwhile, in the below descriptions, since the ribs 110 have the same configuration, only one rib 110 is described and the descriptions of the other ribs 110 are omitted.

The rib 110 is configured to protrude from the slit 121B of the conductor 120 towards the upper, i.e., the sheet P. More specifically, a protrusion amount H1 of the rib 110 from the conductor 120 is set so that when the sheet P, which has passed through the nip portion N and is thus charged, is attracted onto the upper surface of the rib 110, an electric discharge is not caused between the sheet and the conductor 120. The protrusion amount H1 of the rib 110 from the central portion 121 is set to be substantially the same in the front-rear direction. In the meantime, the protrusion amount H1 is not limited thereto and may be arbitrarily set.

The upper surface of the rib 110 is a contact surface 111 that can contact the sheet P and guides the sheet P.

As shown in FIG. 3A, the contact surface 111 continues in the front-rear direction, i.e., the conveyance direction of the sheet P and is configured so that an upstream part thereof in the conveyance direction of the sheet P substantially horizontally extends from the front towards the rear and a downstream part thereof is gradually upwardly inclined from the front towards the rear. In other words, the contact surface 111 is configured so that the downstream side thereof in the conveyance direction of the sheet P is located at a position closer to the photosensitive drum 51 than the upstream side thereof in the facing direction of the transfer roller 53 and the photosensitive drum 51. By this configuration, the contact surface 111 can easily guide the sheet P from the nip portion N towards the fixing device 60. Both the contact surface 111 of the rib 110 and the extension part 122B are obliquely inclined in the rear-upper direction so that they are directed from the nip portion N towards the fixing device 60.

As shown in FIGS. 3A and 3B, the extension part 122B is configured so that a height in the upper-lower direction is smaller than a height of the rib 110 in the upper-lower direction, irrespective of the position in the front-rear direction. In other words, a protrusion amount H2 of the extension part 122B with respect to the central portion 121 is smaller than the protrusion amount H1 of the rib 110 from the conductor 120. Thereby, the extension part 122B is arranged at a position at which it is not contacted to both left and right ends of the sheet P, irrespective of the position in the front-rear direction, i.e., at a spaced position from the sheet P. In the meantime, the protrusion amounts H1, H2 mean the protrusion amounts of the rib 110 and extension part 122B on the basis of the facing surface 121A or virtual plane A. The protrusion amount H2 can be arbitrarily set within a range smaller than the protrusion amount H1.

In the meantime, the end portion 122 is not limited to the above and may be appropriately changed depending on the using modes. For example, the extension part 122B may not be provided, and the protrusion part 122A and the extension part 122B may be separately provided and integrally combined.

Operational effects of the laser printer 1 having the sheet guide 100 configured as described above are described.

As shown in FIG. 1, the sheet P conveyed into the image forming unit 4 passes through the nip portion N formed by the photosensitive drum 51 and the transfer roller 53, is guided by the sheet guide 100 and is then conveyed towards the fixing device 60. In the sheet guide 100, since the conductor 120 has an electric potential that attracts the sheet P, which has passed through the nip portion N and is thus charged, the sheet P is attracted towards the conductor 120.

Here, the protrusion amount H1 of the rib 110 is set so that an electric discharge is not caused between the charged sheet P and the conductor 120. Therefore, there is a possibility that the sheet P will not be sufficiently attracted in an environmental situation where the charging of the sheet P having passed through the nip portion N is weakened.

However, in this exemplary embodiment, since the pair of end portions 122 provided outside the area corresponding to the printing area more protrudes upwardly than the central portion 121, it is possible to bring the pair of end portions 122 closer to the sheet P than the central portion 121. For this reason, while suppressing the electric discharge in the printing area W of the sheet P, it is possible to increase an attraction force of the conductor 120, so that it is possible to easily attract the sheet P towards the conductor 120.

Since the heights of the pair of end portions 122 in the upper-lower direction are smaller than the ribs 110 and the end portions are arranged at the positions spaced from the sheet P, the sheet P is guided towards the fixing device 60 with being contacted to the ribs 110. In the meantime, since the ribs 110 are arranged on the central portion 121 of the conductor 120, the sheet P and the central portion 121 are not contacted to each other, so that the electric discharge in the printing area W is suppressed.

When the end portions 122 are contacted to the sheet P, transfer current may be transferred and leaked from the nip portion N through the sheet P and the end portions 122. However, in this exemplary embodiment, since the end portions 122 are spaced from the sheet P, it is possible to suppress the leak of the transfer current.

Since the contact surfaces 111 of the ribs 110 and the extension parts 122B of the end portions 122 are obliquely inclined in the rear-upper direction so that they are directed from the nip portion N towards the fixing device 60, it is possible to smoothly convey the sheet P towards the fixing device 60. Since the extension parts 122B of the end portions 122 are inclined in conformity with the inclination of the contact surfaces 111 of the ribs 110, it is possible to make a distance between the sheet P and the extension parts 122B be substantially constant, so that it is possible to stabilize the conveyance of the sheet P.

Although the exemplary embodiment has been described, the invention is not limited to the above exemplary embodiment. The specific configuration can be appropriately changed without departing from the scope of the invention. In the below descriptions, the substantially same configurations as those of the above exemplary embodiment are denoted with the same reference numerals and the descriptions thereof are omitted.

In the above exemplary embodiment, the protrusion amounts H2 of the pair of end portions 122 with respect to the central portion 121 are the same at the left and right sides. However, the invention is not limited thereto and the respective protrusion amounts may be different.

Figure 4A:
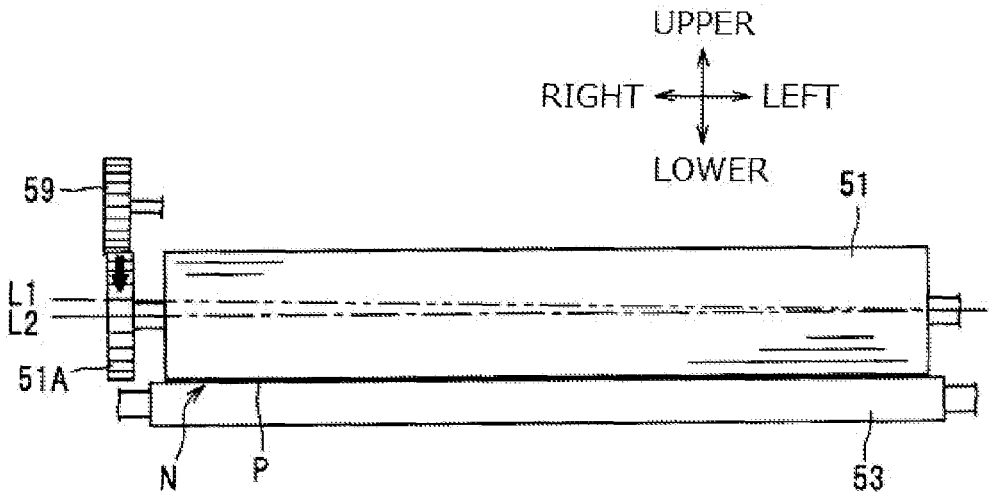
FIG. 4A is a rear view of a photosensitive drum and a transfer roller.

Here, as shown in FIG. 4A, for a configuration where a drum gear 51A provided at a right end side (a left side in FIG. 4A) of the photosensitive drum 51 is connected to a transmission gear 59 provided at the upper side thereof, when a driving force is transmitted to the drum gear 51A by the transmission gear 59, a force is applied in a direction of escaping from the transmission gear 59, i.e., in the lower direction. In conjunction with this, since an axis line L2 of the photosensitive drum 51 is downwardly inclined with respect to a horizontal axis L1 with facing the right end, the nip portion N between the photosensitive drum and the transfer roller 53 is also inclined. For this reason, the sheet P is discharged from the nip portion N at an inclined state where the right end side thereof is downwardly lowered.

Figure 4B:
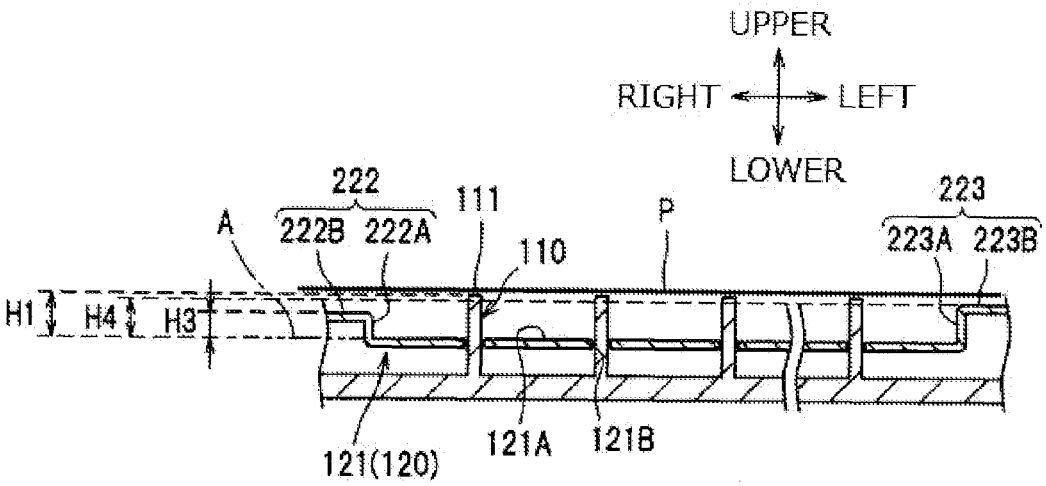
FIG. 4B shows a modified embodiment equivalent to FIG. 3B.

In this case, as shown in FIG. 4B, a protrusion amount H3 of a first end portion 222 of the right end side with respect to the central portion 121 is preferably made to be smaller than a protrusion amount H4 of a second end portion 223 of a left end side opposite to the right end side with respect to the central portion 121.

In this configuration, the first end portion 222 and the second end portion 223 configuring the pair of end portions are respectively configured by protrusion parts 222A, 223A and extension parts 222B, 223B, like the above exemplary embodiment. In the meantime, the respective protrusion amounts H3, H4 are smaller than the protrusion amount H1 of the rib 110 from the conductor 120, like the above exemplary embodiment.

According to the above configuration, since the protrusion amount H3 of the first end portion 222 with respect to the central portion 121 is smaller than the protrusion amount H4 of the second end portion 223 with respect to the central portion 121, distances between both ends of the sheet P, which is discharged with being downwardly inclined as it faces the right end side, and the respective end portions 222, 223 can be easily made to be substantially constant. That is, it is possible to easily attract both left and right ends of the sheet P, which is discharged with being inclined, towards the respective end portions 222, 223 by the substantially same attraction force. For this reason, it is possible to easily convey the sheet P, compared to the configuration where the protrusion amounts of the pair of end portions are the same.

Meanwhile, in the configuration of FIG. 4A, the photosensitive drum 51 and the like are inclined so that the right end sides thereof are lowered. However, since the photosensitive drum 51 is inclined so that the left end side thereof is lowered, contrary to the configuration of FIG. 4A, depending on the positions of the drum gear 51A and the transmission gear 59, the protrusion amount of the first end portion is preferably larger than the protrusion amount of the second end portion.

In the above exemplary embodiment, the contact surface 111 of the rib 110 is obliquely inclined in the rear-upper direction so that it is directed from the nip portion N towards the fixing device 60. However, the invention is not limited thereto and the contact surface may not be inclined. The ribs 110 are preferably provided in two or more rows.

In the above exemplary embodiment, the extension part 122B of the end portion 122 is obliquely inclined in the rear-upper direction so that it is directed from the nip portion N towards the fixing device 60. However, the invention is not limited thereto and the extension part may not be inclined.

In the above exemplary embodiment, the conductor 120 is made of the metal plate. However, the invention is not limited thereto and the conductor may be made of a conductive resin.

In the above exemplary embodiment, the conductor 120 is electrically grounded. However, the invention is not limited thereto and the conductor may be applied with a bias becoming an electric potential that attracts the sheet having passed through the nip portion.

In the above exemplary embodiment, the invention is applied to the laser printer 1. However, the invention is not limited thereto and can be applied to the other image forming apparatus, such as a copier, a complex machine and the like.

In the above exemplary embodiment, the sheet P such as a cardboard, a postcard, a thin sheet and the like has been exemplified as the recording sheet. However, the invention is not limited thereto and an OHP sheet may be also used.

What is claimed is:

1. An image forming apparatus comprising:

a photosensitive drum;

a transfer roller configured to form a nip portion together with the photosensitive drum to transfer an image formed on the photosensitive drum onto a recording sheet; and a sheet guide that is configured to guide the recording sheet having passed through the nip portion along a guide path in a conveyance direction, wherein the sheet guide comprises:

a conductor configured to face the recording sheet, and a plurality of insulating ribs that are arranged, corresponding to a printing area of the recording sheet, in a width direction of the recording sheet substantially perpendicular to the conveyance direction and that are protruding from the conductor to guide the recording sheet, wherein the conductor comprises:

a central portion arranged at an area corresponding to the printing area in the width direction, the central portion including a face that extends in both the width direction and the conveyance direction, and a pair of end portions, each of which is arranged at a corresponding side of the central portion in the width direction and outside the printing area and each of which is protruding towards the guide path relative to the central portion, and wherein the face of the central portion of the conductor is parallel to a face of the pair of end portions of the conductor, and wherein protrusion amounts of the end portions with respect to the central portion are smaller than a protrusion amount of each rib from the central portion of the conductor.

2. The image forming apparatus according to claim 1, wherein a surface of the rib for guiding the recording sheet is formed so that, when measured in a direction from the transfer roller to the photosensitive drum, the surface of the rib at a downstream side in the conveyance direction is located at a position closer to the photosensitive drum than the surface of the rib at an upstream side in the conveyance direction.

3. The image forming apparatus according to claim 2, wherein a surface of the end portion facing the guide path is formed so that, when measured in a direction from the transfer roller to the photosensitive drum, the surface of the end portion at a downstream side in the conveyance direction is located at a position closer to the photosensitive drum than of the surface of the end portion at an upstream side in the conveyance direction.

4. The image forming apparatus according to claim 1, wherein the pair of end portions include a first end portion provided at one end side in the width direction, and a second end portion provided at another end side opposite to the one end side, and wherein a protrusion amount of the first end portion with respect to the central portion is different from a protrusion amount of the second end portion with respect to the central portion.

5. The image forming apparatus according to claim 1, wherein when the sheet guide guides the recording sheet, the end portions of the conductor face an area of the recording sheet outside the recording area.

6. The image forming apparatus according to claim 1, wherein the central portion of the conductor includes slits through which the ribs pass, respectively.

7. An image forming apparatus comprising:

a photosensitive drum;

a transfer roller configured to form a nip portion together with the photosensitive drum to transfer an image formed on the photosensitive drum onto a recording sheet; and a sheet guide that is configured to guide the recording sheet having passed through the nip portion along a guide path in a conveyance direction, wherein the sheet guide comprises:

a conductor configured to face the recording sheet, and a plurality of insulating ribs that are arranged, corresponding to a printing area of the recording sheet, in a width direction of the recording sheet substantially perpendicular to the conveyance direction and that are protruding from the conductor to guide the recording sheet, wherein the conductor comprises:

a first portion, the first portion including a face that extends in both the width direction and the conveyance direction, and a second portion protruding towards the guide path relative to the first portion, and wherein the face of the first portion of the conductor is parallel to a face of the second portion of the conductor, and wherein a protrusion amount of the second portion with respect to the first portion is smaller than a protrusion amount of each rib from the first portion of the conductor.

8. The image forming apparatus according to claim 7, wherein the first portion is arranged at an area corresponding to the printing area in the width direction.

9. The image forming apparatus according to claim 8, wherein the second portion includes third and fourth portions arranged at opposite sides of the first portion in the width direction and outside the printing area.

10. The image forming apparatus according to claim 9, wherein the third portion is provided at one end side in the width direction, and the fourth portion is provided at the other end side opposite to the third portion, and wherein a protrusion amount of the third portion with respect to the first portion is different from a protrusion amount of the fourth portion with respect to the first portion.

11. The image forming apparatus according to claim 7, wherein a surface of the rib guiding the recording sheet is formed so that, when measured in a direction from the transfer roller to the photosensitive drum, the surface of the rib at a downstream side in the conveyance direction is located at a position closer to the photosensitive drum than of the surface of the rib at an upstream side in the conveyance direction.

12. The image forming apparatus according to claim 11, wherein a surface of the second portion facing the recording sheet is formed so that, when measured in a direction from the transfer roller to the photosensitive drum, the surface of the second portion at a downstream side in the conveyance direction is located at a position closer to the photosensitive drum than of the surface of the second portion at an upstream side in the conveyance direction.

13. The image forming apparatus according to claim 7, wherein when the sheet guide guides the recording sheet, the second portions of the conductor face an area of the recording sheet outside the recording area.

14. The image forming apparatus according to claim 7, wherein the first portion of the conductor includes slits through which the ribs pass, respectively.

* * * * *